United States Patent [19]

Aldridge et al.

[11] Patent Number: 4,988,434

[45] Date of Patent: Jan. 29, 1991

[54] REMOVAL OF METALLIC CONTAMINANTS FROM A HYDROCARBONACEOUS LIQUID

[75] Inventors: Clyde L. Aldridge; Roby Bearden, Jr.; Kenneth L. Riley, all of Baton Rouge, La.

[73] Assignee: Exxon Research and Engineering Company, Florham Park, N.J.

[21] Appl. No.: 449,177

[22] Filed: Dec. 13, 1989

[51] Int. Cl.[5] ..... C10G 45/08; C10G 15/00

[52] U.S. Cl. ..... 208/251 H; 208/88; 208/89; 208/92; 208/251 R; 502/182

[58] Field of Search ..... 208/251 H, 251 R, 92, 208/88, 89; 502/182

[56] References Cited

U.S. PATENT DOCUMENTS

| | | | |
|---|---|---|---|
| 2,884,369 | 4/1959 | Mattox et al. | 208/251 R |
| 2,929,776 | 3/1960 | Padovani et al. | 208/251 H |
| 2,938,857 | 5/1960 | Johnson et al. | 208/251 R |
| 2,944,013 | 7/1960 | Holden | 208/251 H |
| 3,013,962 | 12/1961 | Kimberlin, Jr. et al. | 208/251 R |
| 3,095,368 | 6/1963 | Beber et al. | 208/251 R |
| 3,227,645 | 1/1966 | Frumkin et al. | 208/251 R |
| 3,684,688 | 8/1972 | Roselius | 208/251 H |
| 3,915,842 | 10/1975 | Gatsis | 208/251 H |
| 4,073,721 | 2/1978 | Kanbier et al. | 208/251 H |
| 4,430,206 | 2/1984 | Rankel | 208/251 H |
| 4,434,048 | 2/1984 | Schindler | 208/251 H |
| 4,435,277 | 3/1984 | Dinh et al. | 208/251 H |
| 4,705,619 | 11/1987 | McCandlish et al. | 208/251 H |

FOREIGN PATENT DOCUMENTS

| | | | |
|---|---|---|---|
| 1181846 | 11/1964 | Fed. Rep. of Germany | 208/251 R |

*Primary Examiner*—Helane E. Myers

*Attorney, Agent, or Firm*—Roy J. Ott

[57] ABSTRACT

A method of reducing the concentration of metal contaminants, such as vanadium and nickel, in a petroleum distillate or other hydrocarbonaceous liquid is disclosed. The method comprises demetallizing the distillate over an activated-carbon supported vanadium catalyst.

13 Claims, 3 Drawing Sheets

REMOVAL OF METALLIC CONTAMINANTS FROM A HYDROCARBONACEOUS LIQUID

The present invention generally relates to the removal of metallic contaminants from a petroleum distillate. More particularly, the present invention relates to the use of a vanadium catalyst to remove nickel, vanadium, iron, and/or other metal containing compounds from a petroleum distillate.

BACKGROUND OF THE INVENTION

It is well known that as a petroleum resource, e.g. a crude oil or petroleum residuum, is distilled to a higher cut point, the amount recovered as distillate naturally increases. However, as the cut point increases, the concentration of metallic contaminants in the distillate also tends to increase. Metal contaminants including porphyrin or porphyrin-like complexes, are abundant in heavy petroleum distillates. These organo-metallic compounds can be volatized, thus contaminating the distillate fractions. In petroleum processing operations such as catalytic cracking, the presence of these metallic contaminants in the petroleum feed leads to rapid catalyst contamination causing an undesirable increase in hydrogen and coke make, an attendant loss in gasoline yield, a loss in conversion activity and a decrease in catalyst life. The effects of these metallic contaminants on zeolite containing catalysts are described in detail in U.S. Pat. No. 4,537,676. The metallic contaminants are believed to affect the catalyst by blocking the catalyst pore structure and by irreversibly destroying the zeolite crystallinity. The adverse catalytic effects of nickel and vanadium containing compounds, in particular, are discussed by Cimbalo, Foster and Wachtel in "Oil and Gas Journal," May 15, 1972, pages 112–122, and by Bosquet and Laboural in "Oil and Gas Journal," Apr. 20, 1987, pages 62–68.

The removal of metallic contaminants from petroleum distillates such as atmospheric bottoms, heavy gas oils and vacuum gas oils, and vacuum resids is becoming increasingly important as heavier and more metals-contaminated feedstocks are being refined. As a consequence of significant economic incentives, additional efforts are being directed at upgrading them to more valuable products.

In the past, efforts have been directed to the removal of metal contaminants from petroleum distillates by a variety of methods including hydrotreating, deasphalting, and acid extraction.

Hydrotreating technology using CoMo, and/or NiMo catalysts is used for upgrading some feeds for catalytic cracking, but a selective hydrotreating process which is capable of essentially only removing metals without consuming substantial amounts of hydrogen in other reactions has not been available.

U.S. Pat. Nos. 2,926,129 and 3,095,368 describe a method for selectively removing iron, nickel and vanadium from an asphaltene containing petroleum feedstock by deasphalting the oil and subsequently contacting the oil with a mineral acid, such as HCl, to coagulate the metallic compound. The metallic compounds are then separated. This process has the disadvantage of requiring the use of deasphalting, which is an expensive operation, and requiring mineral acids which are highly corrosive.

In a paper presented at a meeting of the ACS Division of Petroleum Chemistry Society (Preprints, Vol. 25, No. 2, pages 293–299, March 1980), Bukowski and Gurdzinska disclosed a method for reducing the adverse catalytic effect of metal contaminants present in the distillate from a atmospheric residuum. The method included heat treating the atmospheric residuum in the presence of cumene hydroperoxide (CHP) for up to six hours at 120° C. This step increased the distillate fraction obtained from the atmospheric residuum feed and decreased the metals content of the distillate which subsequently was used as feed for a catalytic cracking unit. This procedure has the disadvantage that the cost of the large amount (2%) of CHP used is relatively high.

British patent application No. 2,031,011 describes a method for reducing the metals and asphaltene content of a heavy oil by hydrotreating the oil in the presence of a catalyst including a metal component from Group Ib, IIb, IIa, Va, VI, and VIII of the Periodic Table and thereafter deasphalting the oil. Relatively large amounts of hydrogen are required.

Various other patents disclose upgrading a residual oil by initially deasphalting and subsequently demetallizing the deasphalted oil, for example, as variously described in U.S. Pat. Nos. 4,447,313, 2,895,902, 3,227,645, 4,165,274, 4,298,456, 3,511,774 and 3,281,350.

The teachings of the prior art, although proposing possible ways to reduce the metals content in a petroleum distillate, fail to provide a process which is sufficiently effective, practical, inexpensive, and which does not suffer from any of the above-mentioned drawbacks.

BRIEF DESCRIPTION OF THE INVENTION

It is an object of the present invention to provide a process for removing metals from a petroleum distillate or other hydrocarbonaceous liquid. Applicants have found it advantageous to demetallize the distillate over an activated carbon supported vanadium catalyst. This process is applicable to a wide variety of feeds such as petroleum, bitumen, shale oil, coal liquids, etc. or distillates of any of the aforementioned.

In one particular application, wherein a heavy petroleum distillate is upgraded for use as feed to a catalytic cracker, a heavy petroleum feedstock is fractionated in a distillation zone operated under a vacuum to produce an overhead stream comprising a vacuum gas oil, a bottoms stream comprising a vacuum residuum, and a side stream comprising a selected deep cut vacuum gas oil characterized by an initial and final cut point within the range of 800° to 1300° F., and demetallizing this selected deep cut gas oil in a demetallation zone employing a catalyst composition comprising vanadium supported on particles of an activated carbon to obtain a product characterized by a vanadium content of not more than about 15 ppm and a nickel content of not more than about 10 ppm by weight, whereby the demetallized deep cut vacuum gas oil is made suitable for use as feed to a catalytic cracking zone. In an alternate embodiment, a petroleum vacuum residuum can be fractionated in a further distillation zone, to produce an overhead stream comprising a selected distillate fraction, having the characteristics described above, for demetallation according to he present invention.

BRIEF DESCRIPTION OF THE DRAWINGS

The process of the invention will be more clearly understood upon reference to the detailed discussion below in conjunction with the drawings wherein.

DETAILED DESCRIPTION OF THE INVENTION

According to the present process, a petroleum distillate is upgraded by removal of much of its metal contaminants. The present process comprises demetallizing this distillate in a demetallation zone over an activated-carbon supported vanadium catalyst.

In the following description of the invention, the term "final cut point" with respect to a distillate is defined as the atmospheric equivalent of the highest boiling material in the distillate. The term "initial cut point" with respect to a distillate is defined as the atmospheric equivalent of the lowest boiling material in the distillate. These definitions in practice allow for up to 10 wt. %, usually less than 5 wt. %, of material below the "initial cut point" or above the "final cut point" due to inefficiencies and inaccuracies in the real world, for example entrainment or fluctuations of operating conditions.

The term "petroleum distillate" as used herein is meant to include virgin petroleum feedstock or any fraction or distillate thereof.

The term "fractionation" as used herein includes any means for separating the components of a fluid into its components, including extraction, distillation, deasphalting, centrifugation, etc. The term "distillation" as used herein means a specific type of fractionation accomplished in a distillation tower.

The present process can be used to demetallize various petroleum feeds such as whole crude, atmospheric bottoms, heavy catalytic cracking cycle oils (HCCO), coker gas oils, vacuum gas oils (VGO), heavier residua such as vacuum residua, and deasphalted oils which normally contain several percent aromatics, particularly large asphaltenic molecules. Similar feeds derived from fossil fuels such as coal, bitumen, tar sands, or shale oil are also amenable to treatment according to the present invention. In the case of petroleum bottoms, for example vacuum bottoms, the present invention is applicable to directly demetallizing bottoms which are relatively low in metals, e.g. South Louisiana, Brent, or North Sea. Selected distillates of high metals crude, such as Hondo/Monterey, Maya, or Bachaquero crude are also suitable feeds for this invention.

Figure 2:
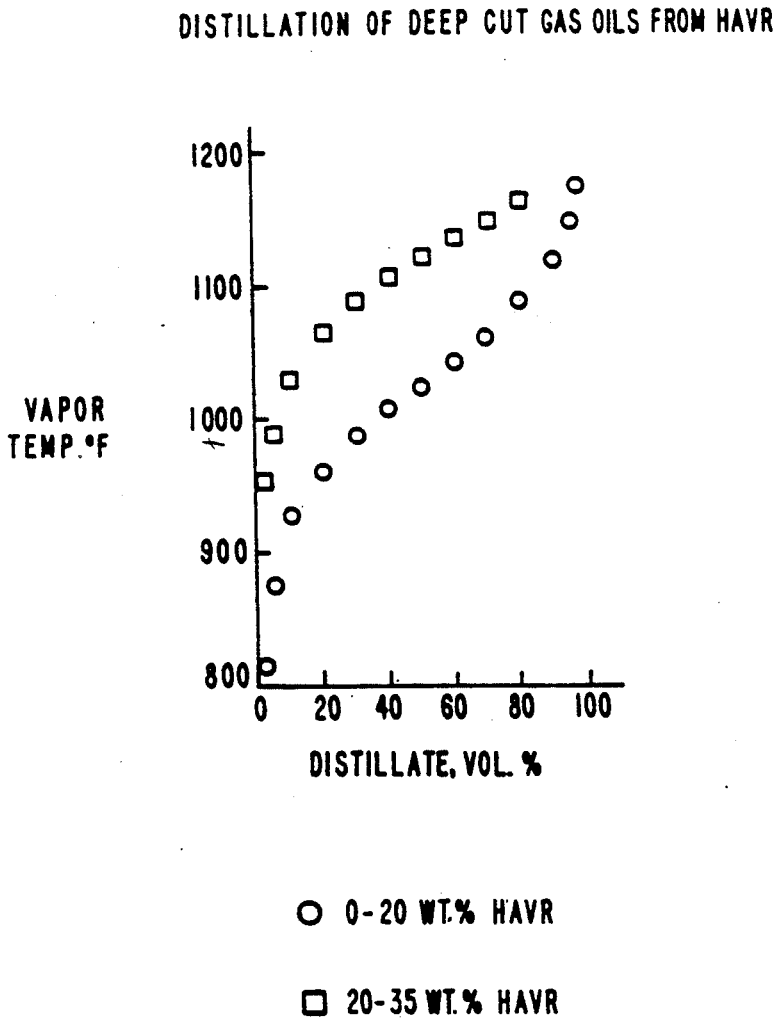
FIG. 2 shows in the form of a graph, distillations of two deep cut gas oils from a heavy Arabian vacuum residuum (HAVR) according to one embodiment of the present invention, in which graph the vapor temperature is plotted versus the distillate volume.

The feed to be demetallized may contain the metals vanadium, nickel, copper, iron and/or others. The average vanadium in the feed is suitably about 15 ppm to 2,000 ppm, preferably about 20 to 1,000 ppm, by weight, most preferably about 20 to 100 ppm. The average nickel content in the feed is suitably about 2 to 500 ppm, preferably about 2 to 250 ppm by weight, most preferably about 2 to 100 ppm. For example, a Heavy Arab crude distillate having an initial cut point of 950° F. and a final cut point of 1160° F. as described in FIG. 2 may have a typical nickel content of 8 ppm and a vanadium content of 50 ppm by weight.

Following demetallation, the product should have an average vanadium level of not more than about 15 ppm by weight, preferably less than about 4 ppm and an average nickel level of not more than about 10 ppm, preferably less than about 2 ppm. Greater than 30 percent by weight of the total vanadium and nickel is thereby removed. The product may be used in refining operations that are adversely affected by higher levels of metals, for example catalytic cracking, or such a product can be blended with other streams of higher or lower metals content to obtain a desired level of metallic contaminants.

In the particular case where the feed is the atmospheric bottoms or residuum of a relatively high metal contaminated feed, it is first fractionated in a vacuum distillation zone to obtain a selected distillate. Such a selected distillate suitably includes those distillates having a boiling range in the range of about 800° to 1300° F., preferably about 1050° to 1200° F. The initial cut point, as defined above, is suitably in the range of 800° to 1050° F., preferably 900° to 1000° F. The final cut point, as defined above, is in the range of 1050° to 1300° F., preferably above 1050° F., for example 1075° to 1300° F., most preferably 1100° to 1300° F.

Figure 1:
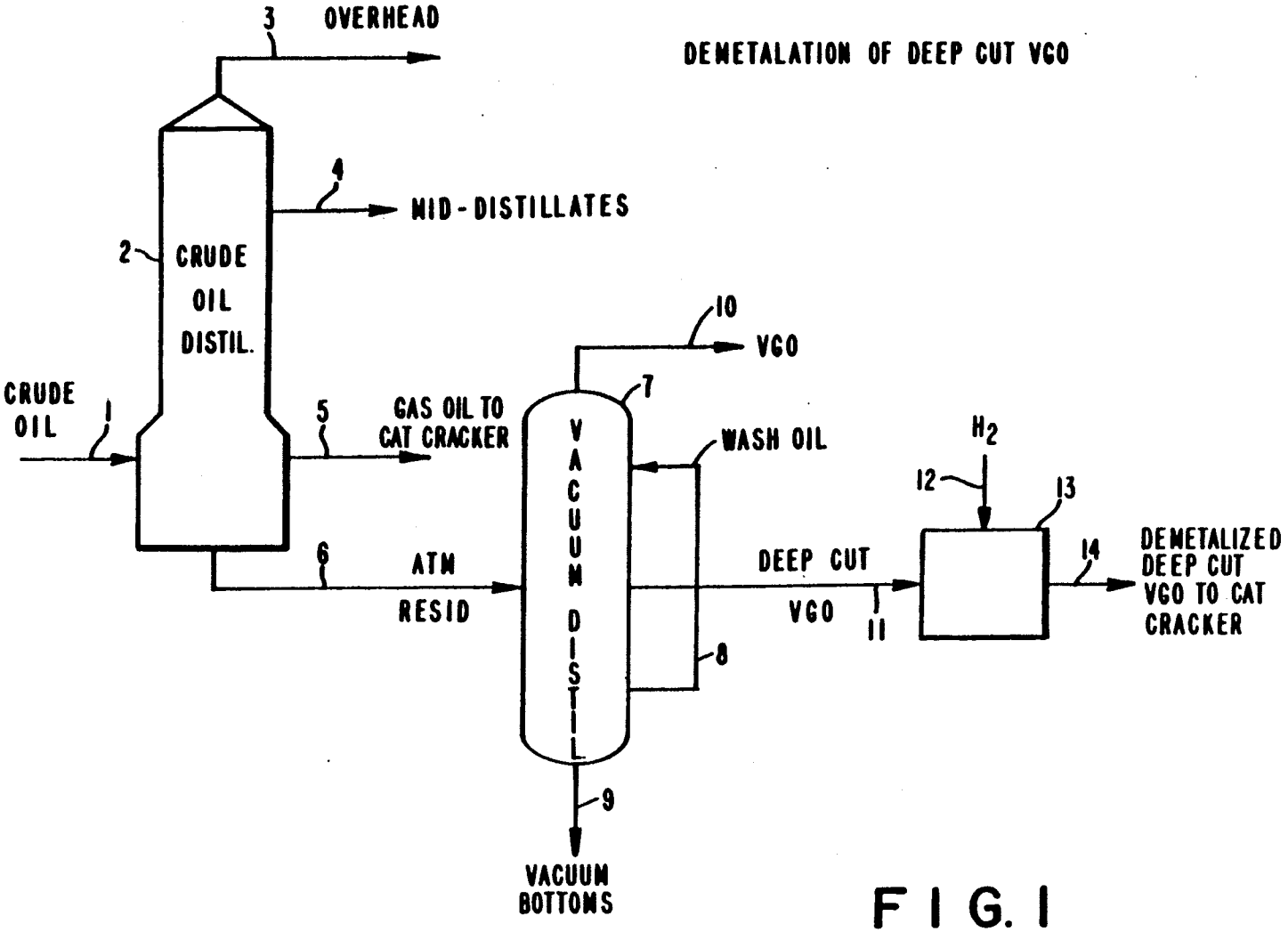
FIG. 1 shows a simplified process flow diagram illustrating one embodiment for practicing the subject invention wherein demetallation of a deep cut vacuum gas oil is accomplished.

FIG. 1 illustrates the particular case where an deep cut gas oil distillate is treated according to the present invention. Referring to FIG. 1, a virgin petroleum crude oil stream 1 is fed into a distillation tower 2. Distillation tower 2 can be operated at atmospheric pressure or under a vacuum. For simplicity, the drawing shows a single overhead stream 3, a single intermediate stream 4, etc. Any number of fractions can be recovered from the distillation zone for further refining. A bottoms fraction or petroleum residuum stream 6 having an initial boiling point in the range of 500° to 1000° F., typically about 650° F., is passed to a vacuum tower 7. The vacuum tower 7 produces an overhead stream 10 comprising a relatively high boiling vacuum gas oil (VGO) typically having a boiling range of 650° F. to 1050° F. A side stream 11, comprising a deep cut VGO fraction is removed from the vacuum tower and introduced into a demetallation zone, by way of example, located in a hydrotreater 13. Hydrogen gas, or a gaseous mixture containing hydrogen, e.g. $H_2/H_2S$, in sufficient amounts, in stream 12 is also introduced into the catalytic reactor 13, and the VGO fraction is therein treated in the presence of an effective amount of catalyst comprising vanadium supported on activated carbon particles. The metals content is thereby reduced to a satisfactory preselected level. This demetallized deep cut VGO in stream 14 is then suitable as feed for a catalytic cracker.

The vacuum tower 7 also produces a vacuum bottom stream 9, which is asphaltene rich and typically contains several hundred ppm by weight of metals such as V and Ni. A wash oil stream 8 in the vacuum tower 7 prevents entrainment of high boiling metal-containing materials.

The present process offers a method of removing metals from various feedstocks before it can contaminate downstream operations. For example, the present process can increase the amount of distillate obtainable from a resid, which distillate can be made suitable as feed to a cat cracker as exemplified above. An advantage of the present process is that existing vacuum towers can be readily retrofitted, for example to take a deep VGO side stream, and expensive new process equipment avoided. In fact, the side stream typically has the required heat (650° F.) for a subsequent hydrotreating reaction. A relatively high feed rate, for example 2 V/V/hr, is suitable of demetallation and the reactor can operate at a relatively low pressure, for example 400 to 800 psig. The capital investment is relatively small and the cost of catalyst is low. In fact, the spent catalyst may approach fresh catalyst in value because of its metals content. Metals recovery is readily accomplished by employing a the carbon supported catalyst of the present invention and burning the catalyst when discharged. Alternatively, the metals may be extracted from the catalyst and the catalyst reused.

The demetallation step of the present process employs a vanadium catalyst composition comprising an activated-carbon support. A suitable activated-carbon support for the catalyst is a lignite based carbon, for example the DARCO brand commercially available from American Norite Company, Inc. (Jacksonville, Fla.). Particularly preferred are high pore volume, large pore diameter carbons such as DARCO. The DARCO carbon has a bulk density of about 0.42 g/cc, a surface area of about 625 $m^2/g$ or 263 $m^2/cc$, a pore volume of about 1.0 cc/g or 0.42 cc/cc, and an average pore diameter of about 64 Å. The percent vanadium on the carbon in the finished catalyst is suitably about 5 to 50 percent by weight, preferably about 5 to 25 percent. After impregnating the support with the metal, as exemplified below, the catalyst is subjected to standard sulfiding at a pressure of about atmospheric to 500 psia with about 2 to 15 percent $H_2S$, preferably about 10 percent by volume, while raising the temperature from 200° to 750° F. for a period of about 4 hrs. to 24 hrs.

EXAMPLE 1

This example illustrates a method of preparing a catalyst according to the present invention. A mixture of 5.33 g $V_2O_5$ (Fisher Scientific), 11.40 g of oxalic acid (Mallinckrodt) and 18.75 g deionized water was placed in a beaker at 78° F. Over a period of 28 minutes the mixture was heated to 152° F. with stirring and held at this temperature for 9 minutes. The net weight of the solution was then adjusted to 31.40 g by evaporation. A sample of 20.0 g of 14/35 mesh DARCO activated carbon was impregnated with 27.07 g of the above solution, allowed to stand at room temperature for 30 minutes and then dried in a vacuum oven at 320° F. overnight. The oven was cooled and 26.8 g of dried catalyst (Notebook No. 16901-86) was recovered which contained 12.87% on carbon.

EXAMPLE 2

This example of a method according to the present invention involved isolation of deep cuts of a gas oil (b.p. 800° to 1160° F.) as initial distillation cuts from a petroleum feed source and hydrotreating this material to demetallize it under mild conditions and low pressure while consuming little hydrogen. The distillation is shown graphically in FIG. 2. The feed source was a heavy Arabian vacuum residuum (HAVR) having the characteristics listed in Table I.

TABLE I

| Feedstock Properties | |
|---|---|
| Description | Heavy Arab Vacuum Resid (HAVR) |
| Gravity, °API | 7.8 |
| Sulfur, Wt. % | 5.15 |
| Total Nitrogen, wppm | 4510 |
| Basic Nitrogen, wppm | — |
| Carbon, Wt. % | 84.54 |
| Hydrogen, Wt. % | 10.37 |
| Microcarbon Residue, Wt. % | 21.4 |
| Asphaltenes, Wt. % | — |
| Aniline Point, °F. | — |
| Metals, wppm | |
| Nickel | 52 |
| Vanadium | 183 |
| Iron | 19 |
| HPLC, Wt. % | |
| Saturates | — |
| 1 Ring Aromatics | — |
| 2 Ring Aromatics | — |
| 3 Ring Aromatics | — |
| 4+ Ring Aromatics | — |
| Polars | — |
| Distillation, °F. | Hi-Vac C |
| 2% | 877 |
| 5% | 944 |
| 10% | 984 |
| 20% | 1003 |
| 30% | — |
| 40% | — |

This feed source was subjected to short path (molecular) distillation to obtain a 0–20 weight % initial fraction and a 20–35 weight % fraction as overhead cuts. The analyses of these two deep cut gas oil fractions are given in Table II below:

TABLE II

| Analyses of Deep Cut Gas Oil Fractions from Molecular Distillation of HAVR | | |
|---|---|---|
| | 0–20 Wt % Cut | 20–35 Wt % Cut |
| Ni, wppm | 3, 3, 2 | 8, 9, 8 |
| V, wppm | 14, 14, 14 | 51, 50, 50 |
| S, wt. % | 3.72 | 3.98 |
| N, wppm | 2019 | 2566 |
| Conradson Carbon, wt. % | 3.70, 3.62 | 6.02, 6.51, 6.31 |
| API Gravity | 13.9 | 12.2 |
| $C_7$ Insolubles, wt. % | 0.23, 0.21, 0.18 | 0.30 |
| $C_5$ Insolubles, wt. % | 1.94, 1.49<br>1.62, 1.68 | 1.07, 1.48<br>1.27, 0.78 |
| Molecular Weight | 640 | 750 |
| C, wt. % | 84.38 | 84.17 |
| H, wt. % | 11.09 | 10.92 |
| Basic N, wppm | 590 | 613 |

Figure 3:
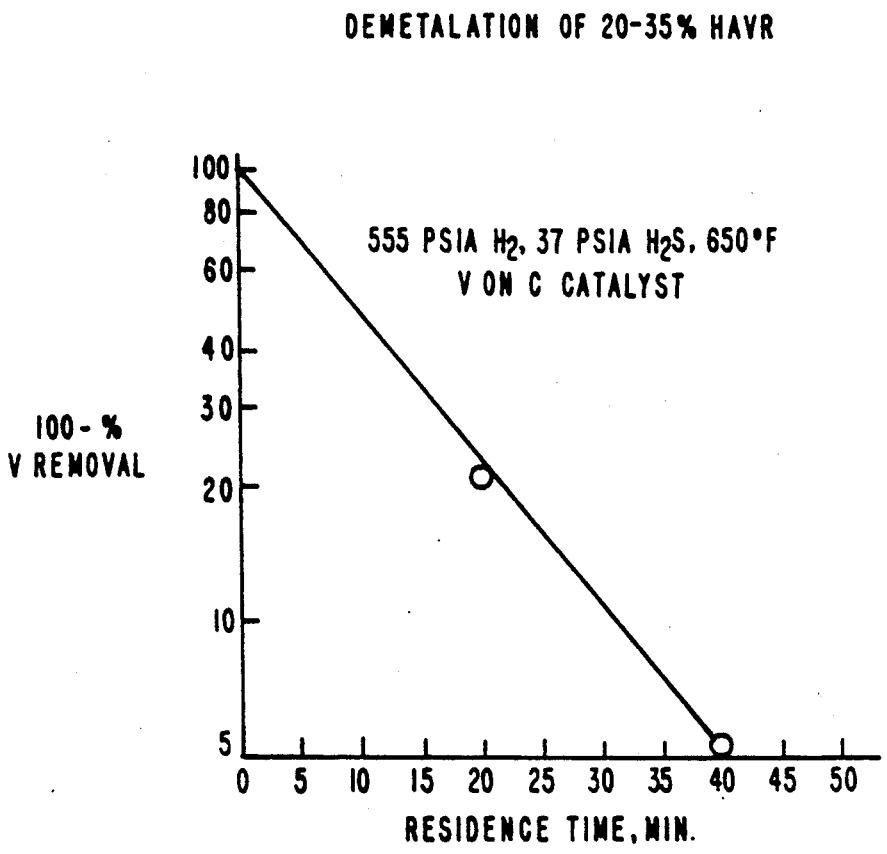
FIG. 3 shows in the form of a graph, a catalytic demetallation of a 20–35 weight percent distillate cut of a HAVR according to one embodiment of the present invention, in which graph the percent vanadium remaining in the HAVR distillate cut is plotted against the residence time of the HAVR distillate cut in the demetallation zone.

In particular, the feed tested was the 20–35 wt. % cut of HAVR having a metals content of 50 wppm V and 8 wppm Ni. Demetallation of this feed was conducted over the catalyst of Example 1 in a fixed bed tubular reactor with continuous gas and liquid flow under the conditions shown in Table III below. The reaction was highly selective with minimal occurrence of other reactions, such as desulfurization or hydrogenation. Hydrogen consumption was only 50 to 150 SCF/Bbl, and there was no detectable gas make. Results of two experiments are shown graphically in FIG. 3 and are tabulated below in Table III.

TABLE III

| Demetallation of 20–35% HAVR Cut | | 650° F., 555 psia $H_2$, 37 psia $H_2S$, 6000 SCF/Bbl Gas Feed | |
|---|---|---|---|
| | Feed | Run 28 | Run 29 |
| V/V/Hr. of gas oil | — | 1.5 | 3.0 |
| V, wppm | 50 | 2.7 | 11 |
| Ni, wppm | 8 | 1 | 1 |
| S, wt. % | 3.93 | 3.52 | 3.78 |
| C, wt. % | 84.24 | 84.63 | 84.48 |
| H, wt. % | 10.92 | 11.14 | 11.08 |
| Conradson Carbon, wt. % | 6.09 | 5.99 | 5.72 |

EXAMPLE 3

This example illustrates the effect of the vanadium loading on the activity of the catalyst in the demetallation zone. A commercially available carbon support, DARCO activated-carbon, used as 14/35 mesh particles, was impregnated with vanadium at the various loadings shown in Table IV below, ranging from about 5 percent to about 20 percent by weight on the activated-carbon, prepared analogously to the procedure of Example 1. The vanadium on carbon was subjected to standard sulfiding. Specifically, the catalyst was charged to a ⅜" tubular reactor (20.0 cc charge) and was sulfided with a gaseous mixture comprising 10.3% hydrogen sulfide in hydrogen for 40 minutes while increasing the temperature from 200° to 450° F. at atmospheric pressure. The catalyst was then maintained at a temperature of 450° F. for 1 hour and 10 minutes. The temperature was increased to 700° F. over a period of 50 minutes and then maintained at 700° F. for 1 hr and 10 min. During this treatment the gas flow was maintained at an exit gas rate of 0.40 l/min $H_2$ as measured in a wet tester meter at atmospheric conditions after removal of the $H_2S$ by caustic scrubbing. The catalyst was then held overnight at static pressure of 110 psig while decreasing the temperature from 700° F. to 400° F.

The activity of each of the prepared catalysts was tested on the 20–35 weight percent fraction of heavy Arabian vacuum residuum at a total pressure of 775 psig and a temperature of 550° F. at a space velocity of 1.5 V/V/hr. The activity is shown in the last column, indicating that over the range studied the vanadium removal activity of the catalyst increases with increasing percentage of vanadium on the carbon support.

TABLE IV

| Effect of Concentration of V in Catalyst on Demetallation Activity | | |
|---|---|---|
| Run No. | Wt. % Vanadium on Carbon | Vanadium Removal, % |
| 57 | 0 | 0 |
| 59 | 5.00 | 44 |
| 52 | 12.87 | 68 |
| 53 | 12.87 | 64 |
| 60 | 12.87 | 64 |
| 61 | 16.08 | 80 |

EXAMPLE 4

A South Louisiana Vacuum Resid (SLVR) was analyzed and found to have the characteristics in Table V below:

TABLE V

| South Louisiana Vacuum Resid (SLVR) Analyses | |
|---|---|
| Con. C., % | 9.71 |
| API Gravity | 12.0 |
| Ni, ppm | 17 |
| V, ppm | 13 |
| Fe, ppm | 42 |
| Sulfur, % | 1.097 |
| N, ppm | 3731 |
| $C_5$ Asph., % | 6.82, 5.61 |
| C, % | 87.35, 87.09 |
| H, % | 11.35, 11.34 |

A 50 wt. % blend of this South Louisiana vacuum resid in toluene was treated over a 20 cc charge of the 12.87 wt. % V on DARCO carbon of Example 1 in a tubular continuous flow reactor. Conditions were 650° F., 1.00 cc/min liquid feed rate equivalent to 1.50 V/V/hr of resid feed, 793 psig total pressure equivalent to 598 psia of $H_2$ partial pressure, gas feed of 11.2% $H_2S$ in $H_2$ at 0.54 l/min rate as determined on the exit gas by measurement with a wet test meter at atmospheric temperature and pressure after caustic scrubbing to remove the $H_2S$. After stripping all the solvent from the product, analysis showed the resid product (Run 67) to contain 10 wppm Ni and 10 wppm V for a 33% removal of nickel and vanadium.

EXAMPLE 5

The deep cut (20–35 wt. %) Heavy Arabian gas oil described in Table II of Example 2, containing 50.3 ppm vanadium, was subjected to demetallization over 12.87 wt. % V on DARCO carbon prepared as described in Example 1. Conditions were 550° F., 550 psia $H_2$ partial pressure and 1.5 V/V/hr of gas oil feed (fed as a 50 wt. % solution in toluene), and 6000 SCF/Bbl of treat gas. During the course of this 160 hour period of operation, the $H_2S$ content of the hydrogen treat gas was systematically varied from 3 to 11% and this variation shown not to affect the amount of vanadium removal. Vanadium remaining in the liquid product is tabulated in Table VI below as a function of run time.

COMPARATIVE EXAMPLE 6

An experiment similar to Example 5 was performed except using a 3.4 wt. % Co and 10.3 wt. % Mo on high surface area alumina catalyst (165 Å average pore diameter). Results are tabulated in Table VI below. Comparison of the results show that while the CoMO on $Al_2O_3$ catalyst has initial activity higher than V on carbon, there is more rapid deactivation of the CoMo and $Al_2O_3$ catalyst and after 60 to 80 hours of use the V on carbon catalyst has retained more activity and has substantially ceased further deactivation.

TABLE VI

| | V in Product, wppm | |
|---|---|---|
| Run Hr. | CoMo on $Al_2O_3$ Catalyst Example 6 | V on Carbon Catalyst Example 5 |
| 10 | 4.0 | 15.0 |
| 20 | 9.6 | 18.2 |
| 40 | 16.6 | 20.9 |
| 60 | 21.0 | 22.4 |
| 80 | 24.2 | 23.5 |
| 100 | 26.1 | 24.3 |
| 120 | 27.4 | 24.8 |
| 140 | — | 25.1 |
| 160 | — | 25.2 |

The process of the invention has been described generally and by way of example with reference to particular embodiments for purposes of clarity and illustration only. It will be apparent to those skilled in the art from the foregoing that various modifications of the process and materials disclosed herein can be made without departure from the spirit and scope of the invention.

What is claimed is:

1. A process for the demetallation of a hydrocarbonaceous oil, the process comprising treating the oil in a demetallation zone, wherein said oil is subjected to hydrogen in the presence of an effective amount of catalyst consisting essentially of vanadium supported on activated carbon to remove from the oil a substantial amount of the metals.

2. A process for the the demetallation of a selected fraction of a heavy fossil fuel feed, the process comprising subjecting said feed to fractionation in a distillation zone operated under a vacuum to produce an overhead stream comprising a vacuum gas oil, a bottoms stream comprising a vacuum residuum, and a side stream comprising a deep cut vacuum gas oil characterized by a final cut point of 1050° to 1300° F., and demetallizing the selected deep cut gas oil in a demetallation zone containing vanadium supported on particles of activated carbon in the presence of gas comprising hydrogen and hydrogen sulfide, whereby at least 30 weight percent of the total nickel and vanadium is removed, to obtain a product characterized by a vanadium content of not more than about 15 ppm and a nickel content of not more than about 10 ppm by weight, whereby the demetallized deep cut vacuum gas oil is suitable as feed for a catalytic cracking zone.

3. The process of claim 1, wherein the hydrocarbonaceous liquid is a petroleum distillate.

4. The process of claim 2, wherein the heavy fossil fuel feed is an atmospheric residuum having an initial cut point above about 650° F.

5. The process of claim 2, wherein a wash oil is circulated from a lower portion of the distillation zone to a higher portion of the distillation zone.

6. The process of claim 2, wherein the deep cut vacuum gas oil has a final cut point of about 1100° to 1300° F.

7. The process of claim 1, wherein the hydrocarbonaceous oil is a petroleum distillate having a combined vanadium and nickel content of less than 100 ppm.

8. The process of claim 1, wherein the hydrocarbonaceous oil is a vacuum residuum.

9. The process of claim 8, wherein the hydrocarbonaceous oil is a vacuum residuum of a whole petroleum crude selected from the group consisting of South Louisiana, Brent, or North Sea.

10. The process of claim 1, wherein the hydrocarbonaceous oil is a whole petroleum crude.

11. The process of claim 1, wherein hydrogen sulfide is introduced into the demetallation zone.

12. The process of claim 2, wherein the side stream has a final cut point of 1100° to 1300° F.

13. The process of claim 1, wherein said oil is the overhead stream from the distillation of a vacuum residuum.

* * * * *